US012390019B1

(12) United States Patent
Yan

(10) Patent No.: US 12,390,019 B1
(45) Date of Patent: Aug. 19, 2025

(54) SIDE STRUCTURE OF PLAYPEN FRAMEWORK, PLAYPEN FRAMEWORK, PLAYPEN, AND FOLDING METHOD OF THE PLAYPEN

(71) Applicant: Yu Yan, Hunan (CN)

(72) Inventor: Yu Yan, Hunan (CN)

( * ) Notice: Subject to any disclaimer, the term of this patent is extended or adjusted under 35 U.S.C. 154(b) by 0 days.

(21) Appl. No.: 19/000,509

(22) Filed: Dec. 23, 2024

(51) Int. Cl.
*A47D 13/06* (2006.01)

(52) U.S. Cl.
CPC ..... *A47D 13/063* (2013.01)

(58) Field of Classification Search
CPC ..... A47D 7/00; A47D 7/002; A47D 11/00; A47D 11/005; A47D 11/007; A47D 13/00; A47D 13/06; A47D 13/061; A47D 13/063; A47D 13/065; A47D 13/066; A47D 13/068
See application file for complete search history.

(56) References Cited

U.S. PATENT DOCUMENTS 3,040,341 A * 6/1962 Hesketh ..... A47D 13/063 5/99.1
3,158,876 A * 12/1964 Gottlieb ..... A47D 13/063 5/99.1
4,070,716 A * 1/1978 Satt ..... A47D 13/063 5/99.1
4,635,305 A * 1/1987 Wyss ..... A47D 7/002 5/99.1
11,330,916 B1 * 5/2022 Zhang ..... E04H 17/18
12,152,402 B1 * 11/2024 Zhang ..... E04H 17/1448
2002/0016991 A1 * 2/2002 Brown ..... A47D 13/063 5/99.1
2020/0146465 A1 * 5/2020 Thorne ..... A47D 13/063
2023/0049901 A1 * 2/2023 Pacella ..... A47D 13/063

* cited by examiner

*Primary Examiner* — George Sun
(74) *Attorney, Agent, or Firm* — HOWARD M COHN and Associates, LLC

(57) ABSTRACT

A side structure of a playpen framework, the playpen framework, a playpen, and a folding method of the playpen are provided. The side structure includes two vertical support rods, two horizontals support rods, two diagonal support rods, and two first connecting rods. First ends of the horizontal support rods are respectively detachably connected to upper ends of the vertical support rods. Second ends of the horizontal support rods are rotatably connected to each other. First ends of the diagonal support rods are respectively rotatable relative to lower ends of the vertical support rods. Second ends of the diagonal support rods are rotatably connected to a connecting position of the horizontal support rods. First ends of the first connecting rods are respectively rotatably connected to the diagonal support rods, and second ends of the first connecting rods are rotatably connected to each other.

19 Claims, 10 Drawing Sheets

SIDE STRUCTURE OF PLAYPEN FRAMEWORK, PLAYPEN FRAMEWORK, PLAYPEN, AND FOLDING METHOD OF THE PLAYPEN

TECHNICAL FIELD

The present disclosure relates to a technical field of fences, and in particular to a side structure of a playpen framework, the playpen framework, a playpen, and a folding method of the playpen.

BACKGROUND

A conventional playpen is generally built by boards. During transportation, the conventional playpen needs to be disassembled into the boards separated from each other. A common consumer has to assemble the boards by himself/herself after purchase. When the conventional playpen needs to be stored, similar disassembly steps are performed. Both assembly and storage of the conventional playpen are quite cumbersome. In addition, such a simple splicing structure of the conventional playpen is generally not stable enough to withstand impact of children's active shaking, and there is a risk of collapse or separation of the conventional playpen.

SUMMARY

The present disclosure provides a side structure of a playpen framework, the playpen framework, a playpen, and a folding method of the playpen to solve a problems of The invention is used to solve the problems of inconvenient splicing and storage of playpens in the prior art.

In a first aspect, the present disclosure provides the side structure of the playpen framework. The side structure comprises two vertical support rods, two horizontal support rods, two diagonal support rods, and two first connecting rods. The two vertical support rods are disposed in a vertical direction and disposed at intervals in a horizontal direction. The two horizontal support rods are disposed in the horizontal direction. First ends of the two horizontal support rods are respectively detachably connected to upper ends of the two vertical support rods. Second ends of the two horizontal support rods are rotatably connected to each other. When the two horizontal support rods are respectively detached from the upper ends of the two vertical support rods, the two horizontal support rods move toward each other through rotating downward.

First ends of the two diagonal support rods are respectively rotatable relative to lower ends of the two vertical support rods. Second ends of the two diagonal support rods are rotatably connected to a connecting position of the two horizontal support rods. The two diagonal support rods are allowed to move toward each other by rotating upward relative to the lower ends of the two vertical support rods.

First ends of the two first connecting rods are respectively rotatably connected to the two diagonal support rods, and second ends of the two first connecting rods are rotatably connected to each other.

In some embodiments, the side structure further comprises two second connecting rods. First ends of the two second connecting rods are respectively rotatably connected to the two horizontal support rods. Second ends of the two second connecting rods are rotatably connected to a connecting position of the two first connecting rods.

In some embodiments, when the side structure is unfolded, the two first connecting rods, and the two horizontal support rods are disposed in parallel.

In some embodiments, the two horizontal support rods define two central points, and the two diagonal support rods define two central points.

In a left-right direction of the side structure, a distance between the first ends of the two first connecting rods is less than a distance between the two central points of the two diagonal support rods, and a distance between the first ends of the two second connecting rods is less than a distance between the two central points of the two horizontal support rods.

In some embodiments, the side structure further comprises an intermediate connecting piece connected to the second ends of the two horizontal support rods. The two horizontal support rods are rotatably connected relative to the intermediate connecting piece. The second ends of the two diagonal support rods are rotatably connected to the intermediate connecting piece.

In a second aspect, the present disclosure provides the playpen framework. The playpen framework comprises a plurality of side structures mentioned above. The plurality of side structures are connected end to end, and each two adjacent side structures share one of the vertical support rods.

In some embodiments, the playpen framework further comprises upper corner connectors. Each of the upper corner connectors comprises a fixing piece and a locking piece detachably connected to the fixing piece. Each fixing piece is slidably sleeved on a corresponding vertical support rod. Each of the horizontal support rods is detachably connected to an upper end of a corresponding vertical support rod through a corresponding fixing piece. Each locking piece is configured to fix a corresponding fixing piece and a corresponding vertical support rod when the playpen framework is unfolded.

In some embodiments, each fixing piece comprises a main body portion. The main body portion defines a mounting hole and a positioning hole defined on an outer wall thereof, and the positioning hole thereof communicates the main body portion thereof and an outside.

Each of the vertical support rods is slidably disposed in a corresponding mounting hole. An upper end of each of the vertical support rods defines an accommodating cavity with an opening extending upward. Each of the vertical support rods defines a fixing hole communicated with the accommodating cavity thereof and the outside. Each locking piece is placed into a corresponding accommodating cavity from the opening of the corresponding accommodating cavity. Each locking piece passes through a corresponding fixing hole and a corresponding positioning hole to relatively fix the corresponding fixing piece and the corresponding vertical support rod.

In some embodiments, each locking piece comprises a locking portion and a first limiting portion. The locking portion thereof is configured to insert into the positioning hole to fix the corresponding fixing piece relative to the corresponding vertical support rod. The first limiting portion thereof is connected to one side of the locking portion thereof and abuts against an inner wall surface of the corresponding vertical support rod.

In some embodiments, each locking piece further comprises an elastic portion. A first end of the elastic portion thereof is connected to the first limiting portion thereof. A second end of the elastic portion thereof is fixedly connected to the corresponding vertical support rod. The elastic portion thereof is configured to drive the first limiting portion thereof to abut against the inner wall surface of the corresponding vertical support rod.

In some embodiments, each fixing piece further comprises a positioning portion connected to an outer wall surface of the main body portion thereof, and the positioning portion thereof defines a fixing groove communicated with the positioning hole thereof. When the playpen framework is unfolded, each locking piece is at least partially inserted into a corresponding fixing groove. The playpen framework further comprises unlocking pieces. Each of the unlocking pieces is at least partially mounted in a corresponding fixing groove and is movable in an axial direction relative to a corresponding positioning portion. Each of the unlocking pieces is capable of driving a portion of a corresponding locking piece located in the corresponding fixing groove to return to a corresponding accommodating cavity.

In some embodiments, hooks are disposed on an outer surface of each of the unlocking pieces. Each positioning portion defines sliding grooves extending in the axial direction. The hooks of each of the unlocking pieces are slidable in the sliding grooves of each positioning portion. Each of the sliding grooves comprises a second limiting portion and a third limiting portion spaced apart from the second limiting portion in a sliding direction. Each second limiting portion is configured to prevent a corresponding unlocking piece from being separated from a corresponding positioning portion. When the hooks of each of the unlocking pieces abut against a corresponding third limiting portion, each of the unlocking pieces drives the portion of the corresponding locking piece to return to the corresponding accommodating cavity, and each of the unlocking pieces is located in a corresponding positioning hole.

In some embodiments, each of the unlocking pieces further comprises a base portion and a driving portion. Each base portion comprises an end cover and a cylinder. The end cover thereof is connected to one end of the cylinder thereof to form an accommodating groove with an opening on one side of each base portion. Each driving portion is connected to a groove bottom wall of a corresponding accommodating groove. Each driving portion at least partially extends out of the opening of the corresponding accommodating groove to drive a corresponding locking piece. A gap is formed between an inner wall of each cylinder and a corresponding driving portion. The hooks of each of the unlocking pieces are disposed on an outer wall of each cylinder.

In some embodiments, the playpen framework further comprises plugs. Each of the plugs is detachably mounted on the upper end of each of the vertical support rods to block the opening of each accommodating cavity.

In some embodiments, each fixing piece comprises a first mounting portion and a second mounting portion connected to the first mounting portion. The first mounting portion thereof and the second mounting portion thereof are disposed at an included angle. A connecting position of the first mounting portion and the second mounting portion of each fixing piece defines the first mounting hole. A first end of one of the two horizontal support rods of an adjacent side structure is rotatably connected to the first mounting portion of each of the side structures. A first end of one of the two horizontal support rods of another adjacent side structure is rotatably connected to the second mounting portion of each of the side structures.

In some embodiments, the plurality of side structures are four side structures, and the four side structures are connected to form a rectangular structure. Four upper corner connectors are provided. An extending direction of the first mounting portion of each fixing piece is perpendicular to an extending direction of the second mounting portion of each fixing piece.

In some embodiments, the playpen framework further comprises lower corner connectors. Each of the lower corner connectors comprises a first assembling portion and a second assembling portion connected to the first assembling portion, and the first assembling portion thereof and the second assembling portion thereof are disposed at an included angle. An assembling hole is defined in a connecting position of the first assembling portion thereof and the second assembling portion thereof. A lower end of each of the vertical support rods is inserted into a corresponding assembling hole. A first end of one of the diagonal support rods of an adjacent side structure is rotatably connected to the first assembling portion of each of the side structures. A first end of one of the diagonal support rods of another adjacent side structure is rotatably connected to the second assembling portion of each of the side structures.

In some embodiments, each of the diagonal support rods comprises a main rod and an assembling piece. A first end of each main rod is connected to each assembling piece, and a second end of each main rod is rotatably connected to the connecting position of the two horizontal support rods of each of the side structures. The first end of each main rod is farther from the two horizontal support rods of each of the side structures than the second end of each main rod. One end of each assembling piece away from each main rod defines an arc surface.

In a third aspect, the present disclosure provides the playpen. The playpen comprises the playpen framework mentioned above and a fabric cover covering side portions and a bottom portion of the playpen framework.

In a fourth aspect, the present disclosure provides the folding method of the playpen mentioned above. The folding method comprises unlocking each fixing piece and the corresponding vertical support rod by each of the unlocking pieces, making each fixing piece to slide downward along the corresponding vertical support rod; and rotating the horizontal support rods respectively detached from the upper ends of the vertical support rods downward, making the diagonal support rods to rotate upward relative to the lower ends of the vertical support rods, making the first connecting rods to rotate upward relative to the diagonal support rod, and making the second connecting rods to rotate upward relative to the horizontal support rods.

The playpen framework of the present disclosure has an unfolded state and a folded state for a user to use and storage. In the unfolded state, the vertical support rods provide vertical support and cooperate with the horizontal support rods to define a height and a shape of the playpen framework. The diagonal support rods cooperate with the vertical support rods and the horizontal support rods to form triangle structures to ensure connection stability of the vertical support rods and the horizontal support rods. The two first connecting rods cooperate with the two diagonal support rods of each of the side structures to form a triangle structure, which further improves stability of the two diagonal support rods of each of the side structures and disperses load borne of the two diagonal support rods of each of the side structures, thereby improving bearing capacity of the playpen framework. In the folded state, the two horizontal support rods of each of the side structures move toward each other by rotating downward, and the two diagonal support rods of each of the side structures move closer to each other by rotating upward. The first connecting rods rotate accordingly to adapt to a folding action of the diagonal support rods. In this way, the playpen framework is folded into a small form that is easy to carry and store.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

Figure 1:
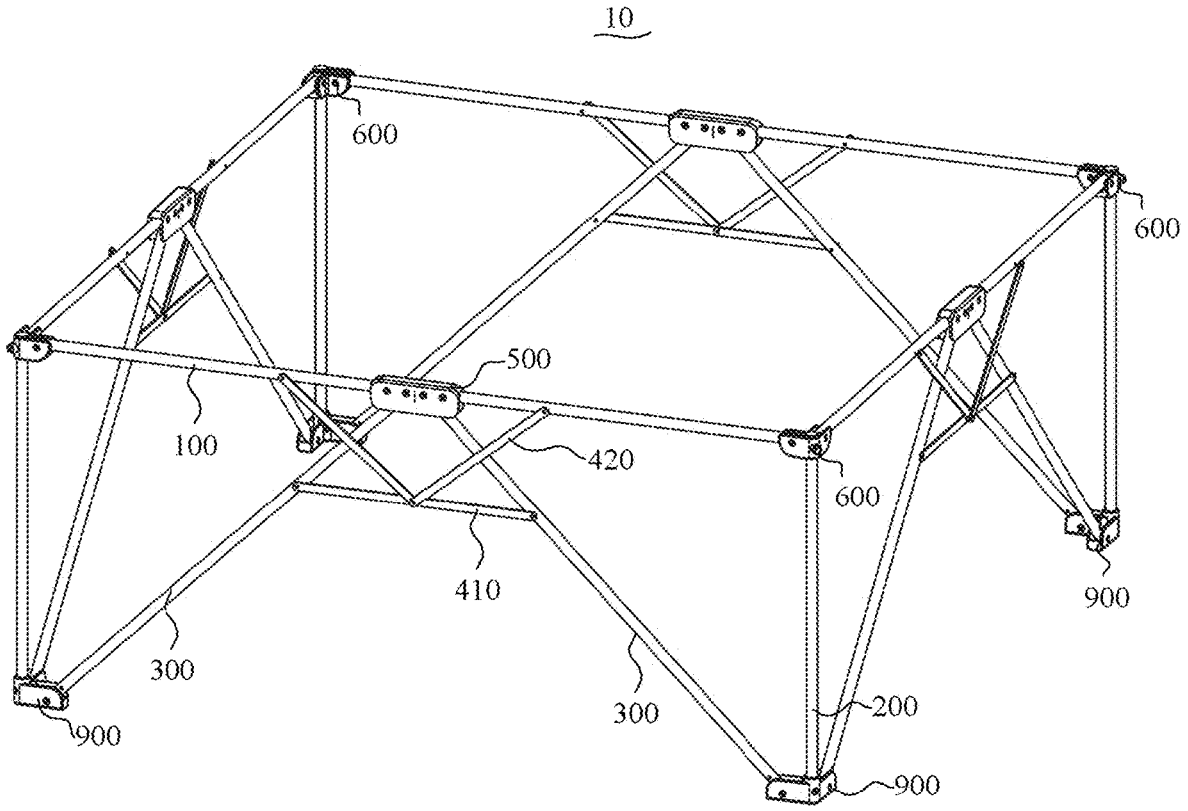
FIG. 1 is a schematic diagram of a playpen framework shown in an unfolded state according to one embodiment of the present disclosure.

In the drawings: 10-playpen framework; 100-horizontal support rod; 200-vertical support rod; 200*a*-accommodating cavity; 200*b*-fixing hole; 300-diagonal support rod; 310-main rod; 320-assembling piece; 410-first connecting rod; 420-second connecting rod; 500-intermediate connecting piece; 510-connecting hole; 600-upper corner connector; 610-fixing piece; 611-main body portion; 611*a*-mounting hole; 611*b*-positioning hole; 6111-first mounting portion; 6112-second mounting portion; 6113-mounting groove; 612-positioning portion; 612*a*-fixing groove; 612*b*-sliding groove; 613-second limiting portion; 614-third limiting portion; 620-locking piece; 621-locking portion; 622-first limiting portion; 700-unlocking piece; 710-base portion; 711-end cover; 712-cylinder; 720-driving portion; 730-hook; 800-plug; 900-lower corner connector; 910-first assembling portion; 920-second assembling portion; 900*a*-assembling hole; 900*b*-assembling groove.

Realization of purposes, functional features, and advantages of the present disclosure is further explained in conjunction with embodiments and with reference to the accompanying drawings.

DETAILED DESCRIPTION

In order to make the purpose, technical solutions, and advantages of the present disclosure clear, the following section will further describe the embodiments of the present disclosure in detail with reference to the accompanying drawings.

When the following description refers to the drawings, the same numbers in different drawings refer to the same or similar elements unless otherwise indicated. The implementations described in the following exemplary embodiments do not represent all implementations consistent with the present disclosure. Rather, they are merely examples of apparatus and methods consistent with certain aspects of the present disclosure, as detailed in the appended claims.

It should be understood in the description of the present disclosure that terms such as "first" and "second" are only used for the purpose of description, rather than being understood to indicate or imply relative importance or hint the number of indicated technical features. Thus, the feature limited by "first" and "second" can explicitly or implicitly include at least one feature. Unless otherwise indicated, the term "a plurality of" means two or more. The term "and/or" depicts relationship between associated objects and there are three relationships thereon. For example, A and/or B may indicate A exists alone, A and B exist at the same time, and B exists alone. The character "/" generally indicates that the associated object is alternative. The terms "first", "second", "third", etc. in the present disclosure are used only to distinguish similar objects and do not imply a specific ordering of objects.

Unless otherwise defined, all technical and scientific terms used herein have the same meaning as commonly understood by those skilled in the art of the present disclosure. The terminology used in the specification is for the purpose of describing specific embodiments only and is not intended to limit the present disclosure. As used herein, the term "and/or" includes any and all combinations of one or more of the associated listed items.

The present disclosure provides a playpen. The playpen comprises a playpen framework and a fabric cover. The fabric cover covers side portions and a bottom portion of the playpen framework 10. The playpen framework 10 is a basic structure of the playpen and is mainly configured to provide support. The playpen framework 10 may be made of a strong and durable material (such as metal or hard plastic). The fabric cover may be made of cotton cloth, chemical fiber gauze, polyethylene cloth (PE cloth) etc. The fabric cover covers the playpen framework 10 to define an enclosed space served as a baby play area or a pet activity area. It is understood that the fabric cover and the playpen framework 10 are detachable, and a user is able to replace or wash the fabric cover and the playpen framework 10 as needed to keep the playpen clean and hygienic.

As shown in FIG. 1, the playpen framework 10 comprises four side structures connected end to end. The four side structures are connected to form a rectangular structure. Of course, in other embodiments, a quantity of the side structures may be three, five, six, etc. Each of the side structures comprises two vertical support rods 200, two horizontal support rods 100, two diagonal support rods 300, and two first connecting rods 410. Each two adjacent side structures share one of the vertical support rods 200. For instance, four vertical support rods are provided. The four vertical support rods 200 are disposed at intervals along an outer circumference of the playpen framework 10.

As shown in FIG. 1, the two horizontal support rods 100 of each of the side structures are disposed in a horizontal direction. First ends of the two horizontal support rods 100 of each of the side structures are respectively detachably connected to upper ends of the two vertical support rods 200 of each of the side structures. Second ends of the two horizontal support rods 100 are rotatably connected to each other. When the two horizontal support rods 100 are respectively detached from the upper ends of the two vertical support rods 200, the two horizontal support rods 100 move toward each other through rotating downward. First ends of the two diagonal support rods 300 of each of the side structures are respectively rotatable relative to the lower ends of the two vertical support rods 200. Second ends of the two diagonal support rods 300 of each of the side structures are rotatably connected to a connecting position of the two horizontal support rods 100 of each of the side structures. The two diagonal support rods 300 of each of the side structures are allowed to move toward each other by rotating upward relative to the lower ends of the two vertical support rods 200. First ends of the two first connecting rods 410 are respectively rotatably connected to the two diagonal support rods 300, and second ends of the two first connecting rods 410 are rotatably connected to each other.

Figure 2:
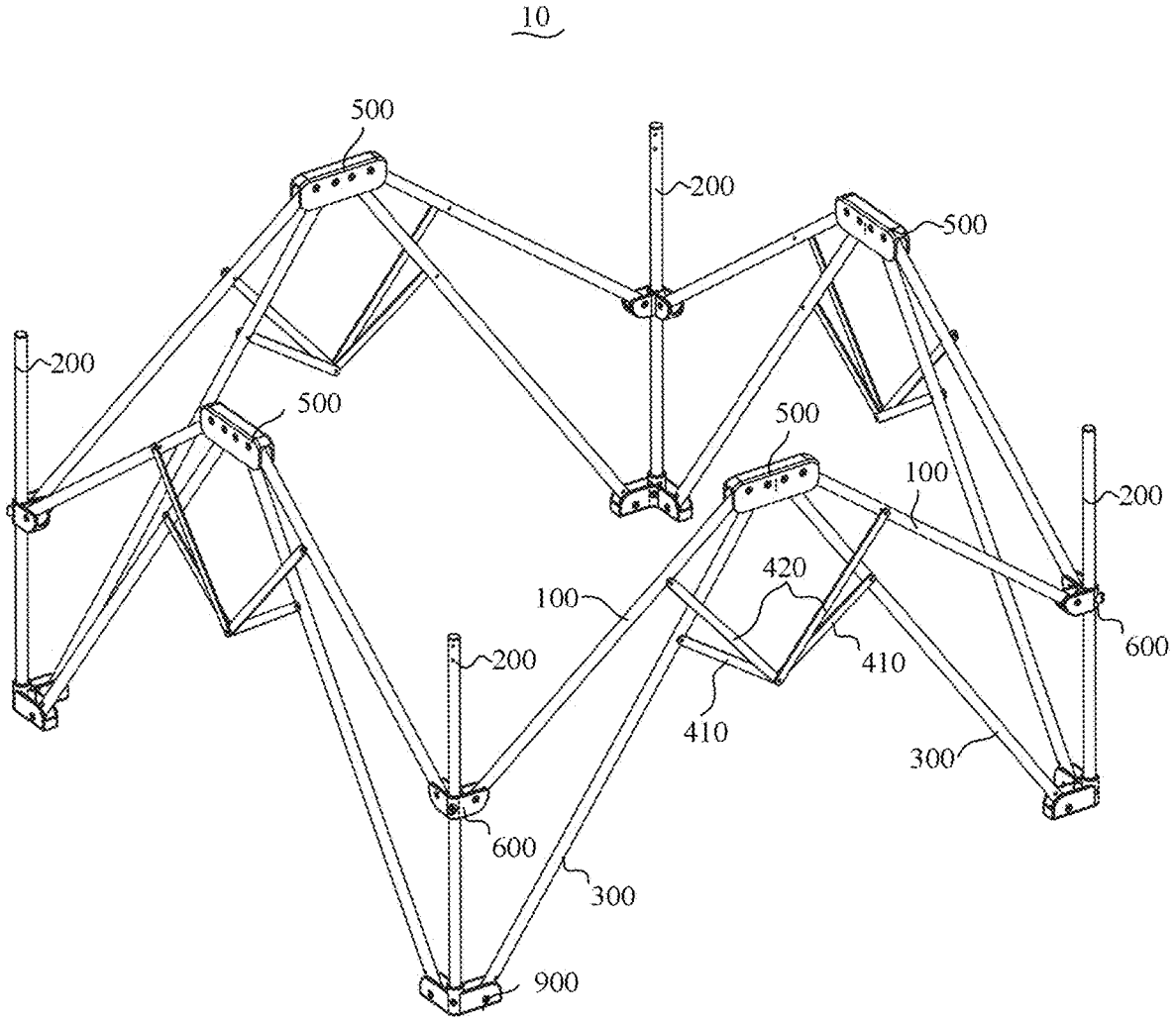
FIG. 2 is a schematic diagram of the playpen framework shown in a partially folded state according to one embodiment of the present disclosure.
Figure 3:
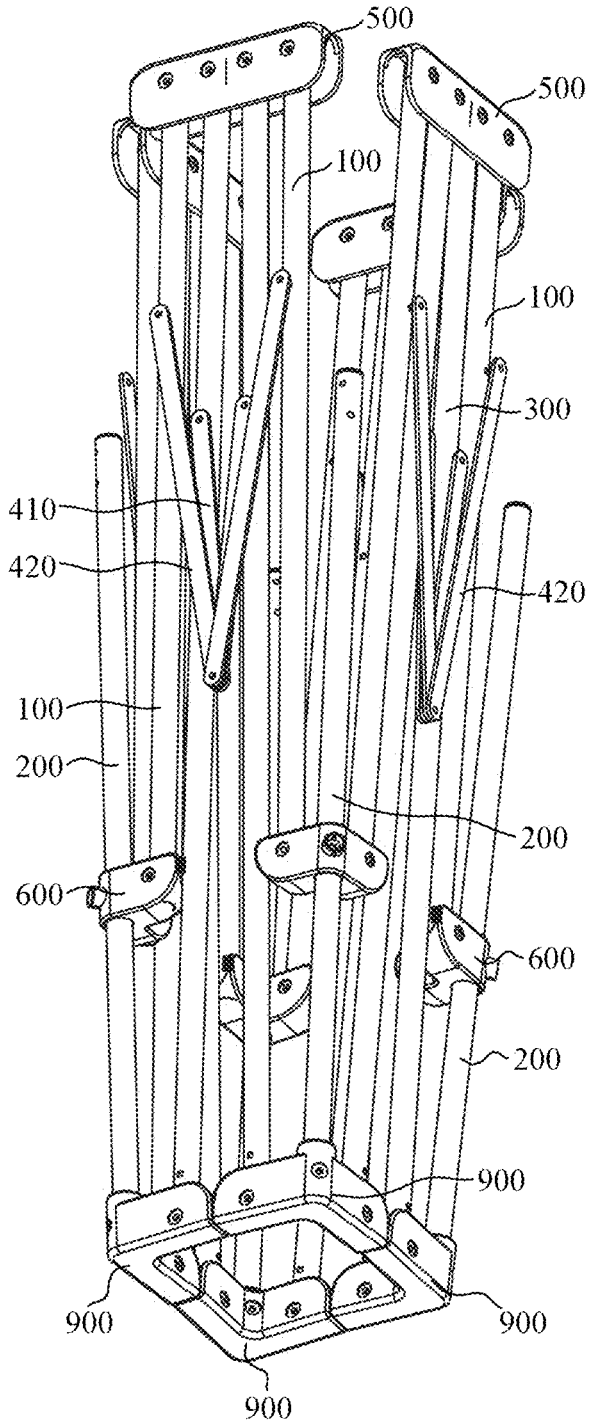
FIG. 3 is a schematic diagram of the playpen framework shown in a folded state according to one embodiment of the present disclosure.

As shown in FIGS. 1-3, the playpen framework 10 of the present disclosure has an unfolded state and a folded state for a user to use and storage. As shown in FIG. 1, in the unfolded state, the vertical support rods 200 provide vertical support and cooperate with the horizontal support rods 100 to define a height and a shape of the playpen framework 10. The diagonal support rods 300 cooperate with the vertical support rods 200 and the horizontal support rods 100 to form triangle structures to ensure connection stability of the vertical support rods 200 and the horizontal support rods 100. The two first connecting rods 410 cooperate with the two diagonal support rods 300 of each of the side structures to form a triangle structure, which further improves stability of the two diagonal support rods 300 of each of the side structures and disperses load borne of the two diagonal support rods 300 of each of the side structures, thereby improving bearing capacity of the playpen framework 10. As shown in FIG. 3, in the folded state, the two horizontal support rods 100 of each of the side structures move toward each other by rotating downward, and the two diagonal support rods 300 of each of the side structures move closer to each other by rotating upward. The first connecting rods 410 rotate accordingly to adapt to a folding action of the diagonal support rods 300. In this way, the playpen framework 10 is folded into a small form that is easy to carry and store.

Furthermore, the fabric cover covers an inner side of the playpen frame 10, with an open upper end and a closed lower end. Specifically, the fabric cover is a rectangular structure matched with the playpen frame 10. Sleeves are vertically disposed on corners of the fabric cover, and the sleeves are respectively sleeved on outer peripheries of the vertical support rods 200 to achieve the connection between the fabric cover and the vertical support rods 200. A connecting portion is disposed on an upper portion of the fabric cover, and the connecting portion extends from the upper portion of the fabric cover. Zippers are respectively disposed on the connecting portion and the fabric cover match each other. The upper portion of the fabric cover is fixed to the horizontal support rods 100 by the connecting portion and the zippers.

As shown in FIG. 1, in some embodiments, each of the side structures further comprises two second connecting rods 420. First ends of the two second connecting rods 420 thereof are respectively rotatably connected to the two horizontal support rods 100 thereof. Second ends of the two second connecting rods 420 thereof are rotatably connected to a connecting position of the two first connecting rods 410 thereof. In this way, the two second connecting rods 420 thereof cooperate with the two horizontal support rods 100 to form a triangle structure, thereby improving the stability of the two first connecting rods 410 thereof in the unfolded state. The second connecting rods 420 thereof further disperses the load borne by the playpen framework 10, thereby enhancing the stability of the playpen.

As shown in FIG. 1, furthermore, when each of the side structure is unfolded, the two first connecting rods 410 thereof and the two horizontal support rods 100 thereof are disposed in parallel. The two first connecting rods 410 and the two horizontal support rods 100 of each of the side structures that are disposed in parallel form a stable frame mechanically, which more effectively disperses and resists external forces, thereby reducing a risk of structural deformation and damage of each of the side structures. In contrast, if the two first connecting rods 410 and the two horizontal support rods 100 of each of the side structures are not disposed in parallel, unnecessary torque or shear force may be generated between them, which easily leads to structural instability. Moreover, by arranging the two first connecting rods 410 and the two horizontal support rods 100 of each of the side structures disposed in parallel is conducive to more evenly distributing the load borne by the playpen framework 10. When the load borne is evenly distributed, the stress borne by each of components of each of the side structures is reduced, thereby improving the load-bearing capacity of the playpen framework 10.

Figure 4:
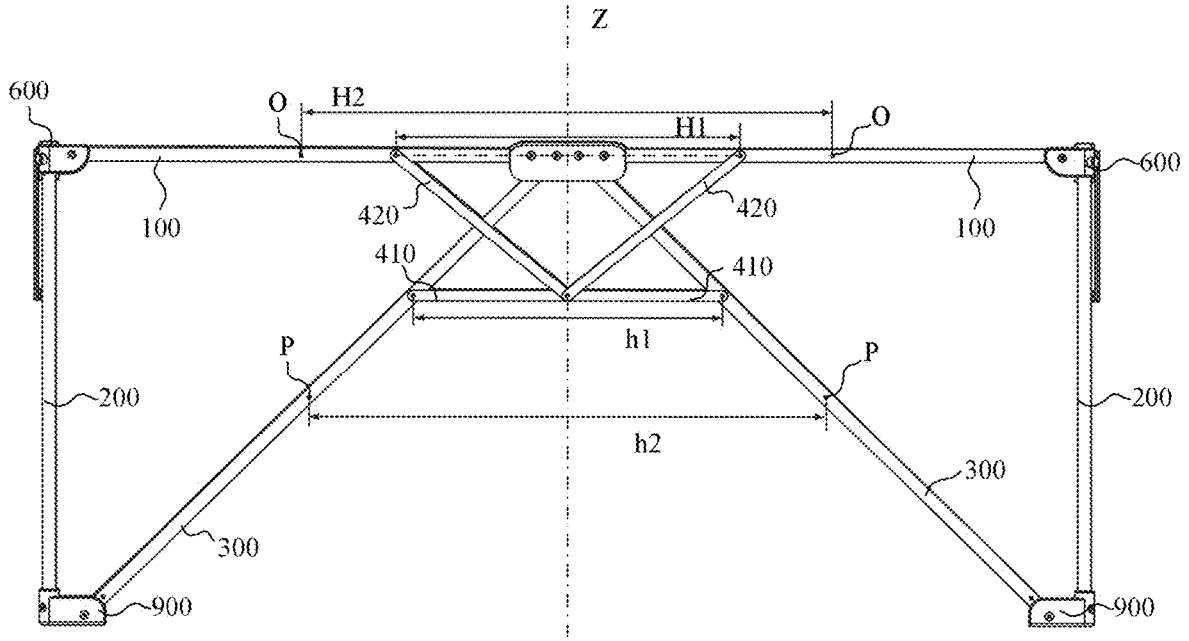
FIG. 4 is a side schematic diagram of the playpen framework according to one embodiment of the present disclosure.

In some embodiments, as shown in FIG. 4, each of the side structures of the playpen framework 10 defines a central axis Z extending in the vertical direction. The two horizontal support rods 100 define two central points O, and the two diagonal support rods 300 define two central points P. The two horizontal support rods 100, the two diagonal support rods 300, the two vertical support rods 200, the two first connecting rods 410, and the two second connecting rods 420 of each of the side structures are symmetrically disposed relative to the central axis Z. In this way, it is ensured that the playpen framework 10 is uniformly supported in the horizontal direction and the vertical direction and is stable in the horizontal direction and the vertical direction. A symmetrical structure of each of the side structures effectively resists influence of various external forces and environmental factors, and maintains the shape and stability of the playpen framework 10. In addition, the symmetrical structure of each of the side structures enables the playpen framework 10 to distribute the load more evenly when subjected to the external forces, thereby reducing the stress borne by each of the components due to the symmetrical structure of each of the side structures and improving the bearing capacity of the playpen framework 10.

In a left-right direction of each of the side structures, a distance h1 between the first ends of the two first connecting rods 410 thereof is less than a distance h2 between the two central points P of the two diagonal support rods 300 thereof, and a distance H1 between the first ends of the two second connecting rods 420 thereof is less than a distance HE between the two central points O of the two horizontal support rods 100 thereof. The two first connecting rods 410 and the two second connecting rods 420 of each of the side structures are closer to the central axis Z of each of the side structures. That is, lengths of the two first connecting rods 410 and the two second connecting rods 420 of each of the side structures are relatively short, which not only reduces the amount of materials used and reduces manufacturing costs, but also reduces an overall weight of the playpen framework10 and improves convenience of installation. The two first connecting rods 410 and the two second connecting rods 420 of each of the side structures are made more compact in each of the side structures, making the central axis Z of each of the side structures of the playpen framework 10 tighter, which enhances rigidity and stability of the joints of the two horizontal support rods 100 and the two oblique support rods 300 of each of the side structures, so that the playpen framework10 is able to resist external loads and deformation, and the overall stability and safety of the playpen framework10 are ensured.

Furthermore, the two first connecting rods 410 of each of the side structures are connected to outer surfaces of the two diagonal support rods 300 of each of the side structures, and the two second connecting rods 420 of each of the side structures are connected to outer surfaces of the horizontal support rods 100 and outer surfaces of the two first connecting rods 410.

Figure 8:
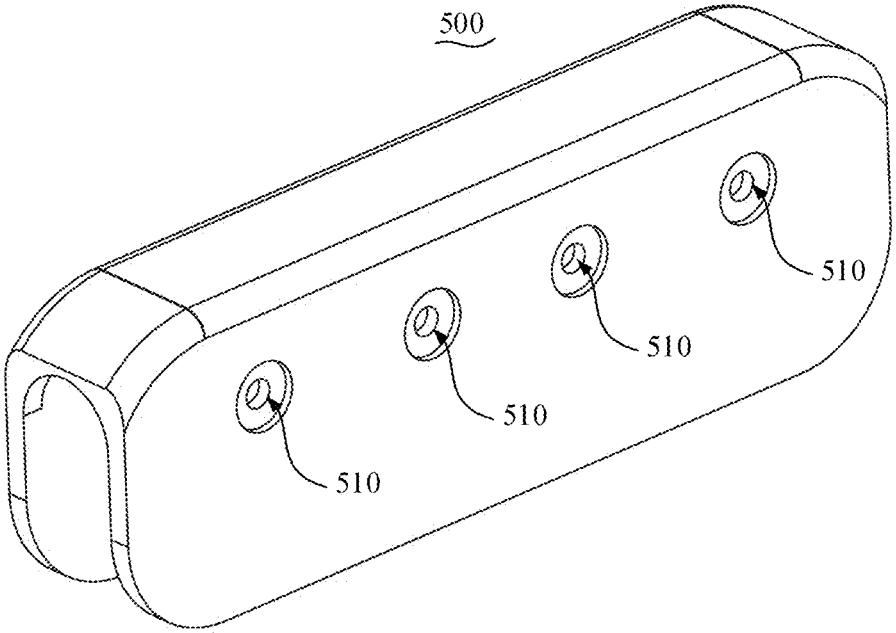
FIG. 8 is a schematic diagram of an intermediate connecting piece according to one embodiment of the present disclosure.

In some embodiments, as shown in FIGS. 1 and 8, each of the side structures further comprises an intermediate connecting piece 500 connected to the second ends of the two horizontal support rods 100 thereof. The two horizontal support rods 100 of each of the side structures are rotatably connected relative to the intermediate connecting piece 500 of each of the side structures. The second ends of the two diagonal support rods 300 of each of the side structures are rotatably connected to the intermediate connecting piece 500 of each of the side structures. Each intermediate connecting piece 500 is a straight rod with a notch penetrating through a left side, a right side and a lower side of each intermediate connecting piece 500. Four connecting holes 510 are sequentially disposed along a length direction of each intermediate connecting piece 500, and the four connecting holes 510 thereof are configured to connect to the two horizontal support rods 100 and the two diagonal support rods 300 of each of the side structures. Specifically, the two horizontal support rods 100 of each of the side structures are inserted into each intermediate connecting piece 500 respectively from the left side and the right side of each intermediate connecting piece 500 and are respectively rotatably connected to two of the four connecting holes 510 located on an outer side. The upper ends of the two diagonal support rods 300 are inserted into each intermediate connecting piece 500 from the lower side of each intermediate connecting piece 500 from two directions and are rotatably connected to two of the four connecting holes 510 located in a middle portion of each intermediate connecting piece 500.

In some embodiments, as shown in FIGS. 1-3, the playpen framework 10 further comprises upper corner connectors 600 and lower corner connectors 900. Optionally, four upper corner connectors 600 and four lower corner connectors 900 are provided. Each two adjacent side structures are connected through a corresponding upper corner connector 600 and a corresponding lower corner connector 900. The first ends of two of the horizontal support rods 100 of the two adjacent side structures share the one of the vertical support rods 200 through each of the upper corner connectors 600. Each of the upper corner connectors 600 is sleeved on each of the vertical support rods 200 and is slidable relative to each of the vertical support rods 200 in a height direction. The two of the horizontal support rods 100 of the two adjacent side structures are rotatably connected through each of the upper corner connectors 600, and each of the upper corner connectors 600 slides on each of the vertical support rods 200 to achieve folding of the playpen framework 10. Each of the lower corner connectors 900 is fixed to a lower end of each of the vertical support rods 200, and the lower ends of two of the oblique support rods 300 of the two adjacent side structures share the one of the vertical support rods 200 through each of the lower corner connectors 900, and the lower ends of two of the diagonal support rods 300 of the two adjacent side structures are rotatably connected to each of the lower corner connectors 900 to achieve folding of the playpen framework 10.

Figure 5:
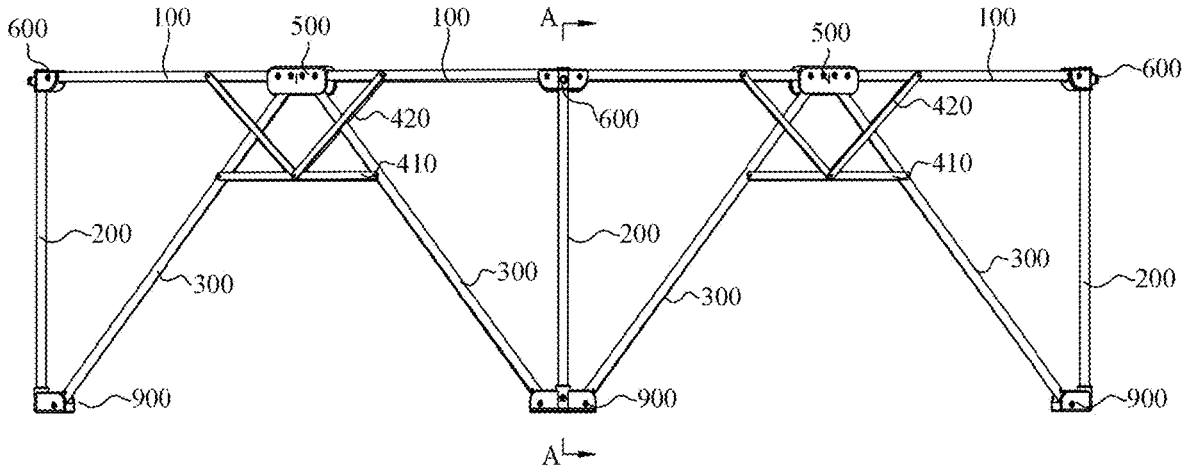
FIG. 5 is another side schematic diagram of the playpen framework according to one embodiment of the present disclosure.
Figure 6:
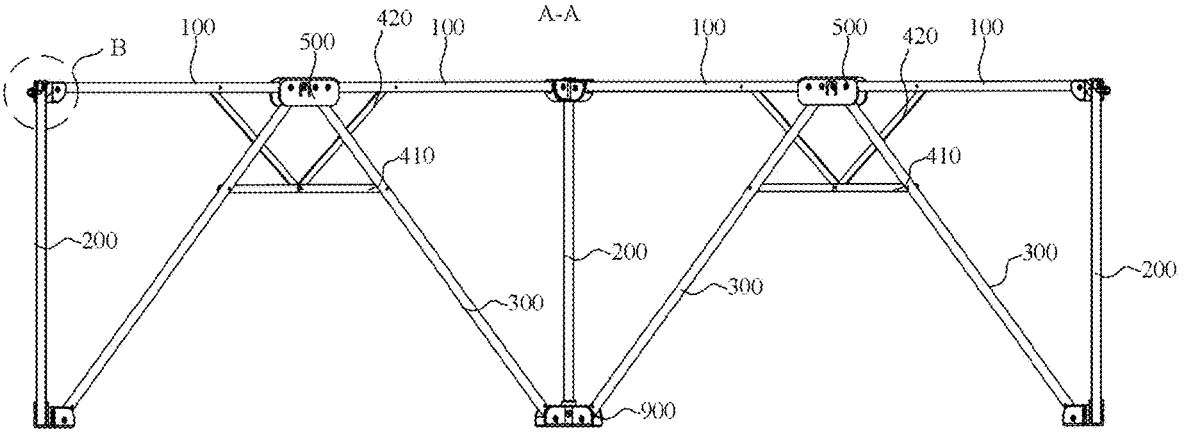
FIG. 6 is a cross-sectional schematic diagram of the playpen framework taken along the line A-A shown in FIIG. 5.
Figure 7:
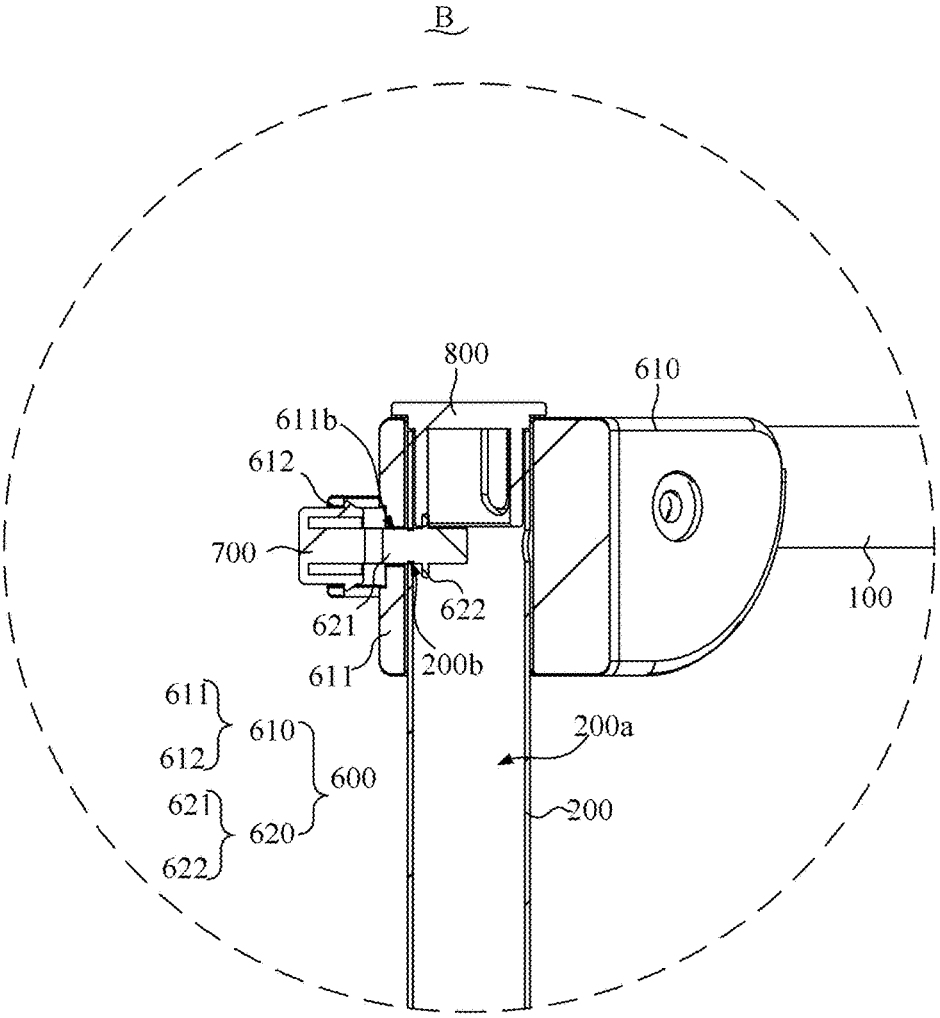
FIG. 7 is an enlarged schematic diagram of area B shown in FIIG. 6.

As shown in FIGS. 5-7, each of the upper corner connectors 600 comprises a fixing piece 610 and a locking piece 620 detachably connected to the fixing piece 610. Each fixing piece 610 is slidably sleeved on each of the vertical support rods. Each of the horizontal support rods 100 is detachably connected to an upper end of each of the vertical support rods through each fixing piece 610. Each locking piece 620 is configured to fix each fixing piece 610 and each of the vertical support rods when the playpen framework 10 is unfolded. It is understood that each fixing piece 610 comprises a mounting hole 611*a*. Each of the vertical support rods 200 is relatively slidably disposed in each mounting hole 611*a*. Each locking piece 620 is a threaded fastener (such as a bolt, a screw, etc.). A bolt hole is defined in each fixing piece 610, and each of the vertical support rods 200 and each fixing piece 610 are fastened together by each locking piece 620. Each locking piece 620 may be a clamping structure disposed on each fixing piece 610. Each of the vertical support rods 200 is clamped in each fixing piece 610. However, the present disclosure does not limit a specific form of each fixing piece 610 and a specific form of each locking piece 620, and each fixing piece 610 and each locking piece 620 may be an integrated structure or separated structures.

Figure 9:
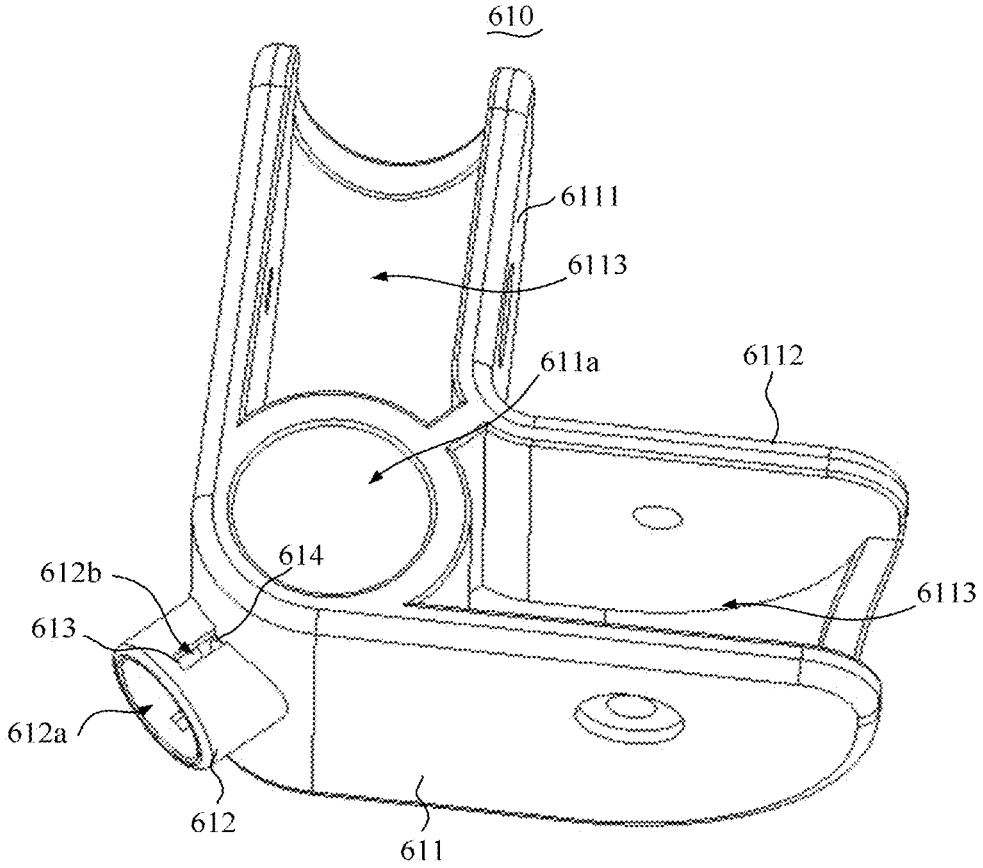
FIG. 9 is a schematic diagram of a fixing piece according to one embodiment of the present disclosure.

In some embodiments, as shown in FIGS. 9, each fixing piece 610 comprises a main body portion 611 and a positioning portion 612. The main body portion 611 defines the mounting hole 611*a* and a positioning hole 611*b* defined on an outer wall thereof, and the positioning hole 611*b* thereof communicates the main body portion 611 thereof and an outside. Each of the vertical support rods 200 is slidably disposed in each mounting hole 611*a*. An upper end of each of the vertical support rods 200 defines an accommodating cavity 200*a* with an opening extending upward. Each of the vertical support rods 200 defines a fixing hole 200*b*, the fixing hole 200*b* thereof is configured to communicate with the accommodating cavity 200*a* thereof and the outside. Each locking piece 620 is placed into each accommodating cavity 200*a* from the opening of each accommodating cavity 200*a*. Each locking piece 620 passes through each fixing hole 200*b* and each positioning hole 611*b* to relatively fix each fixing piece 610 and each of the vertical support rods.

Specifically, when the playpen framework 10 is unfolded, each fixing piece 610 is slid upward along each of the vertical support rods 200, and when each fixing piece 610 slides to a desired position, each locking piece 620 is placed into each accommodating cavity 200*a* from the opening of each accommodating cavity 200*a* and each locking piece 620 passes through each fixing hole 200*b*, each mounting hole 611*a*, and each positioning hole 611*b* to fix each fixing piece 610 relative to each of the vertical support rods 200. In the process, each locking piece 620 is completely accommodated in each accommodating cavity 200*a*, realizing a concealed installation of each locking piece 620. When the playpen framework 10 needs to be folded, a portion of each locking piece 620 is returned to each accommodating cavity 200*a*, and each fixing piece 610 is then allowed to slide downward along each of the vertical support rods 200.

In some embodiments, each locking piece 620 comprises a locking portion 621 and a first limiting portion 622. Each locking portion 621 is configured to insert into each positioning hole 611*b* to fix each fixing piece 610 relative to each of the vertical support rods 200. Each first limiting portion 622 is connected to one side of each locking portion 621 and abuts against an inner wall surface of each of the vertical support rods 200. A shape and a size of each locking portion 621 are matched with each positioning hole 611*b* and each fixing hole 200*b* to ensure that each locking portion 621 is smoothly inserted into and fixed in each fixing hole 200*b* and each positioning hole 611*b*. Each first limiting portion 622 abuts against the inner wall surface of each of the vertical support rods 200, which prevents each locking piece 620 from excessively moving or falling out in each positioning hole 611*b*, thereby enhancing a fixing effect of each locking piece 620 on each fixing piece 610 and each of the vertical support rods 200. Each first limiting portion 622 may be an annular protrusion disposed around each locking portion 621, or each first limiting portion 622 may be a plurality of protrusions disposed at intervals along a circumference of each locking portion 621, which is not limited thereto.

In some embodiments, each locking piece 620 further comprises an elastic portion (not shown in the drawings). In each locking piece 620, a first end of the elastic portion thereof is connected to the first limiting portion 622 thereof, a second end of the elastic portion thereof is fixedly connected to each of the vertical support rods 200. The elastic portion thereof is configured to provide elastic force and drive the first limiting portion 622 thereof to abut against the inner wall surface of each of the vertical support rods 200. A connection method between each elastic portion and each of the vertical support rods 200 comprises but is not limited to one or more forms such as bonding, welding, clamping, screwing, etc. Of course, in some embodiments, each locking piece 620 may not comprise the elastic portion, and each locking portion 621 is connected to each fixing hole 200*b* and/or each positioning hole 611*b* through interference fit; or each locking piece 620 and each of the vertical support rods 200 are relatively fixed by bonding the limiting portion thereof with a cavity wall of each accommodating cavity 200*a*.

It should be noted that the locking piece 620 may be an integral structure, and the locking portion 621 thereof, the first limiting portion 622 thereof, and the elastic portion thereof are integrally molded. For instance, each elastic portion may be an elastic arm, an elastic buckle, etc. Of course, each locking piece 620 may be separated structures composed of two components, where a first component thereof is molded with the locking portion 621 thereof and the first limiting portion 622 thereof, and a second component thereof forms the elastic portion thereof. Specifically, the second component may be a spring, an elastic sheet, etc.

In order to facilitate each locking piece 620 to withdraw from each positioning hole 611*b*, so as to unlock each fixing piece 610 and each of the vertical support rods 200, as shown in FIG. 7, the playpen framework 10 further comprises unlocking pieces 700. In order to facilitate mounting of each of the unlocking pieces 700, each fixing piece 610 further comprises a positioning portion 612 connected to an outer wall surface of the main body portion 611 thereof, and the positioning portion 612 thereof defines a fixing groove 612*a* communicated with the positioning hole 611*b* thereof. When the playpen framework 10 is unfolded, each locking piece 620 is at least partially inserted into each fixing groove 612*a*. Each of the unlocking pieces 700 is at least partially mounted in each fixing groove 612*a* and is movable in an axial direction relative to each positioning portion 612. Each of the unlocking pieces 700 is capable of driving a portion of each locking piece 620 located in each fixing groove 612*a* to return to each accommodating cavity 200*a*. When it is necessary to unlock the playpen framework, the user is able to move each of the unlocking pieces 700 by pressing, so that each of the unlocking pieces 700 contacts each locking piece 620 and applies a driving force to overcome a friction with the inner wall of each of the vertical support rods 200 or the elastic force of each elastic portion, so that the portion of each locking piece 620 is returned into each accommodating cavity 200*a*.

Figure 10:
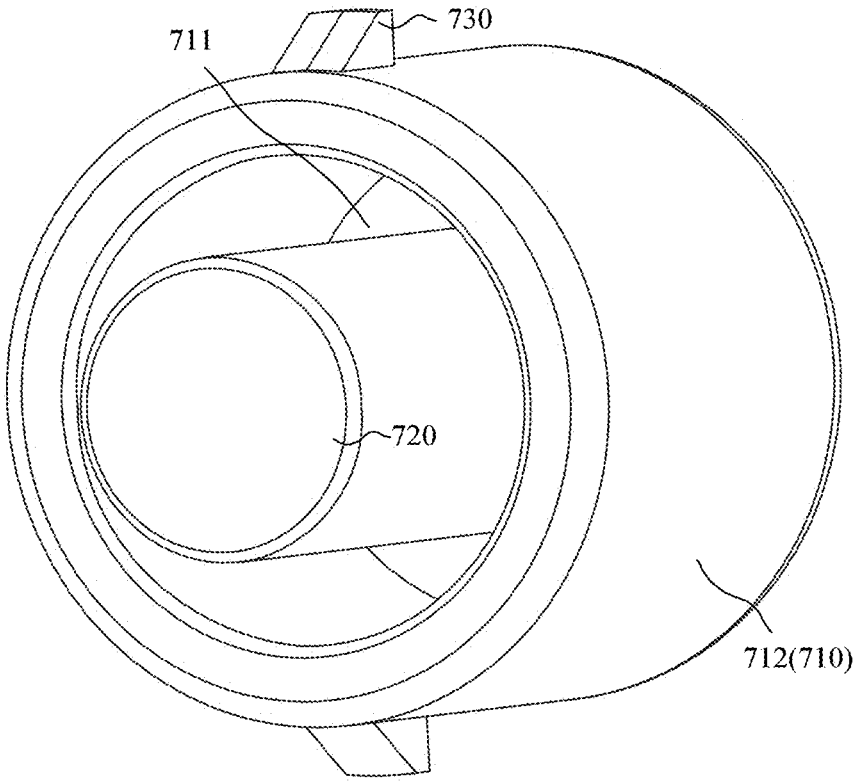
FIG. 10 is a schematic diagram of an unlocking piece according to one embodiment of the present disclosure.

In some embodiments, as shown in FIG. 10, hooks 730 are disposed on an outer surface of each of the unlocking pieces 700. Each positioning portion 612 defines sliding grooves 612*b* extending in the axial direction. Each of the hooks 730 is slidable in each of the sliding grooves 612*b*. Each of the sliding grooves 612*b* comprises a second limiting portion 613 and a third limiting portion 614 spaced apart from the second limiting portion 613 in a sliding direction. When unlocking, the user is able to press each of the unlocking pieces 700 to make each of the unlocking pieces 700 slide along each of the sliding grooves 612*b*. During a sliding process, each of the hooks 730 contacts a groove wall of each of the sliding grooves 612*b* and is guided by each of the sliding grooves 612*b* to a certain extent. When each of the hooks 730 abuts against each third limiting portion 614, each of the unlocking pieces 700 drives the portion of each locking piece 620 to return to each accommodating cavity 200*a* (i.e., the first limiting portion thereof do not abut against the inner wall of each of the vertical support rods). Moreover, each of the unlocking pieces 700 is located in each positioning hole 611*b*. At this time, unlocking of the playpen framework 10 is achieved, and each of the unlocking pieces 700 is prevented from inserting into each accommodating cavity 200*a*, thereby preventing each of the unlocking pieces 700 from interfering with each of the vertical support rods 200. When each locking piece 620 is located in each positioning hole 611*b*, each locking portion 621 drives each of the unlocking pieces 700 to move in an opposite direction. Each of the sliding grooves 612*b* comprises the second limiting portion 613. When each of the unlocking pieces 700 is driven by each locking piece 620, each of the hooks 730 abuts against each second limiting portion 613, thereby preventing each of the unlocking pieces 700 from being separated from each positioning portion 612.

In some embodiments, as shown in FIG. 10. Each of the unlocking pieces 700 further comprises a base portion 710 and a driving portion 720. Each base portion 710 comprises an end cover 711 and a cylinder 712. The end cover 711 thereof is connected to one end of the cylinder 712 thereof to form an accommodating groove with an opening on one side of each base portion. Each driving portion 720 is connected to a groove bottom wall of each accommodating groove. Each driving portion 720 at least partially extends out of the opening of each accommodating groove to drive each locking piece 620. A gap is formed between an inner wall of each cylinder 712 and each driving portion 720. The hooks 730 of each unlocking piece are disposed on an outer wall of each cylinder 712. The gap between the inner wall of each cylinder 712 and each driving portion 720 makes each cylinder 712 have a certain deformation ability. In this way, each cylinder 712 is able to compress each locking piece 620 in each fixing groove 612*a*, and the outer wall surface of each cylinder 712 abuts against the groove wall of each fixing groove 612*a*. The sliding and limiting the unlocking pieces 700 are achieved by the hooks 730 thereof and the sliding grooves 612*b*, which improve the stability of movement of the unlocking pieces 700 and protect the unlocking pieces 700.

When unlocking, each driving portion 720 contacts each locking piece 620 when each of the unlocking pieces 700 is pressed to slide to an appropriate position. By applying a driving force, each driving portion 720 overcomes the friction between each locking piece 620 and the inner wall of each of the vertical support rods 200 or each driving portion 720 overcomes the elastic force of each elastic portion, so that the portion of each locking piece 620 returns into each accommodating cavity 200*a*. As each locking piece 620 returns, an unlocking function is realized.

In some embodiments, as shown in FIG. 7, the playpen framework 10 further comprises plugs 800. Each of the plugs 800 is detachably mounted on the upper end of each of the vertical support rods 200 to block the opening of each accommodating cavity 200*a*. Each of the plugs 800 is of a columnar structure, and limiting holes are respectively defined in two sides of each of the plugs 800. Elastic snappers are respectively disposed in the limiting holes. Each of the plugs 800 is connected to the upper end of each of the vertical support rods 200 by abutting against the inner wall of each of the vertical support rods 200 through the elastic snappers thereof.

In some embodiments, as shown in FIG. 9, each fixing piece 610 comprises a first mounting portion 6111 and a second mounting portion 6112 connected to the first mounting portion 6111. The first mounting portion 6111 thereof and the second mounting portion 6112 thereof are disposed at an included angle. A connecting position of the first mounting portion 6111 and the second mounting portion 6112 of each fixing piece 610 defines the first mounting hole 611*a*. The first mounting portion 6111 and the second mounting portion 6112 of each fixing piece 610 comprise mounting grooves 6113. A first end of one of the two horizontal support rods 100 of an adjacent side structure is rotatably connected to the mounting groove of the first mounting portion 6111 of each of the side structures. A first end of one of the two horizontal support rods 100 of another adjacent side structure is rotatably connected to the mounting groove 6113 of the second mounting portion 6112 of each of the side structures. Optionally, the playpen framework 10 comprises four side structures and four upper corner connectors 600, and an extending direction of the first mounting portion 6111 is perpendicular to an extending direction of the second mounting portion 6112 of each fixing piece 610.

Each of the mounting grooves 6113 defines a first limit position and a second limit position. When each of the horizontal support rods 100 is in the first limit position, each of the horizontal support rods 100 is in a vertical state or a slightly inclined state. When each of the horizontal support rods 100 is switched from the first limit position to the second limit position, each of the horizontal support rods 100 is rotated from the vertical state or the slightly inclined state to a horizontal state. When the playpen framework 10 is folded, two adjacent horizontal support rods 100 of each two adjacent side structures are respectively rotated toward the one of the vertical support rods 200 and are in the vertical state or the slightly inclined state. When the playpen framework 10 is unfolded, the two adjacent horizontal support rods 100 of each two adjacent side structures are respectively rotated away from the one of the vertical support rods 200 and are in the horizontal state.

Figure 11:
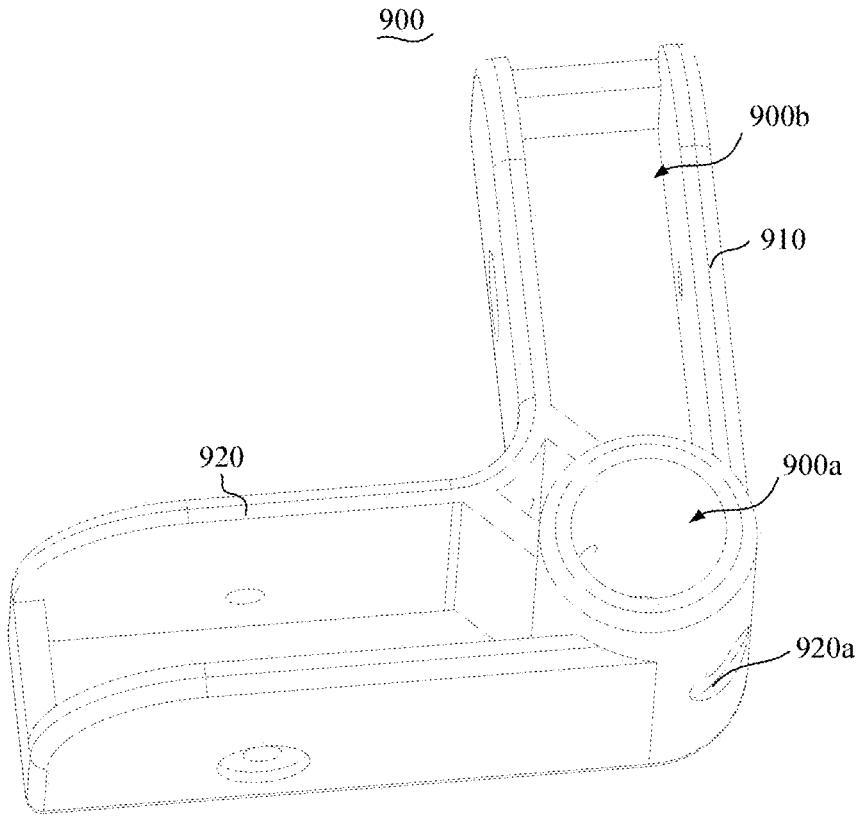
FIG. 11 is a schematic diagram of a lower corner connector according to one embodiment of the present disclosure.

In some embodiments, as shown in FIG. 11, the playpen framework 10 further comprises lower corner connectors 900. Each of the lower corner connectors 900 comprises a first assembling portion 910 and a second assembling portion 920 connected to the first assembling portion 910, and the first assembling portion 910 thereof and the second assembling portion 920 thereof are disposed at an included angle. An assembling hole 900*b* is defined in a connecting position of the first assembling portion 910 thereof and the second assembling portion 920 thereof. Each first assembling portion 910 and each second assembling portion 920 comprise assembling grooves 900*b*. A lower end of each of the vertical support rods 200 is inserted into each assembling hole 900*b*. A first end of one of the diagonal support rods 300 of an adjacent side structure is rotatably connected to the assembling groove of the first assembling portion 910 of each of the side structures. A first end of one of the diagonal support rods 300 of another adjacent side structure is rotatably connected to the assembling groove of the second assembling portion 920 of each of the side structures. Optionally, an extending direction of the first assembling portion 910 is perpendicular to an extending direction of the second assembling portion 920 of each of the side structures.

Each of the mounting grooves 6113 defines a third limit position and a fourth limit position. When each of the diagonal support rods 300 is in the third limit position, each of the diagonal support rods 300 is in a vertical state. When each of the diagonal support rods 300 is switched from the third limit position to the fourth limit position, each of the diagonal support rods 300 is rotated from the vertical state to an inclined state. When the playpen framework 10 is folded, two adjacent diagonal support rods 300 of each two adjacent side structures are respectively rotated toward the one of the vertical support rods 200 and are in the vertical state When the playpen framework 10 is unfolded, the two adjacent diagonal support rods 300 of each two adjacent side structures are respectively rotated away from the one of the vertical support rods 200 and are in the inclined state.

Figure 12:
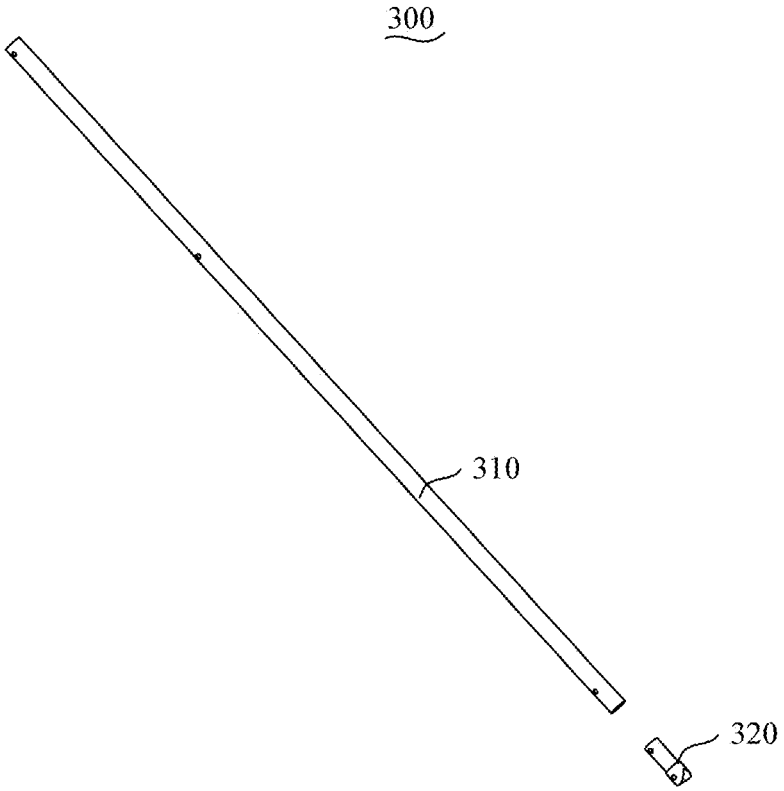
FIG. 12 is a schematic diagram of a diagonal support rod according to one embodiment of the present disclosure.

In some embodiments, as shown in FIG. 12 each of the diagonal support rods 300 comprises a main rod 310 and an assembling piece 320. A first end of each main rod 310 is connected to each assembling piece 320, and a second end of each main rod 310 is rotatably connected to the connecting position of the two horizontal support rods 100 of each of the side structures. The first end of each main rod 310 is farther from the two horizontal support rods 100 of each of the side structures than the second end of each main rod 310. One end of each assembling piece 320 away from each main rod 310 defines an arc surface. In this way, a processing of the diagonal support rods 300 is facilitated, and each arc surface makes each of the diagonal support rods 300 smoother during the rotation process to avoid interference.

The present disclosure provides a folding method of the playpen mentioned above. The folding method comprises steps S01-S02.

The step S01 comprises unlocking each fixing piece 610 and the corresponding vertical support rod by each of the unlocking pieces 700, making each fixing piece 610 to slide downward along the corresponding vertical support rod.

The step S02 comprises rotating the horizontal support rods 100 respectively detached from the upper ends of the vertical support rods 200 downward, making the diagonal support rods 300 to rotate upward relative to the lower ends of the vertical support rods 200, making the first connecting rods 410 to rotate upward relative to the diagonal support rod, and making the second connecting rods 420 to rotate upward relative to the horizontal support rods 100.

During a folding process, the fabric cover is folded along with folding of the playpen framework. The playpen is conveniently and quickly folded by using the folding method.

In the drawings of the embodiments, the same or similar numbers correspond to the same or similar components. In the description of the present disclosure, it should be understood that terms such as "upper", "lower", "left", "right" etc. indicate direction or position relationships shown based on the drawings, and are only intended to facilitate the description of the present disclosure and the simplification of the description rather than to indicate or imply that the indicated device or element must have a specific direction or constructed and operated in a specific direction. Therefore, the terms used to describe positional relationships in the drawings are only for illustrative purposes and cannot be construed as limitations of the present disclosure. For those of ordinary skill in the art, the specific meanings of the above terms can be understood according to specific circumstances.

The above are only optional embodiments of the present disclosure and are not intended to limit the present disclosure. Any modifications, equivalent substitutions, and improvements made within the spirit and principles of the present disclosure shall be included in the protection scope of the present disclosure.

What is claimed is:

1. A side structure of a playpen framework, comprising:
two vertical support rods;
two horizontal support rods;
two diagonal support rods; and
two first connecting rods;
wherein the two vertical support rods are disposed in a vertical direction and disposed at intervals in a horizontal direction;
wherein the two horizontal support rods are disposed in the horizontal direction, first ends of the two horizontal support rods are respectively detachably connected to upper ends of the two vertical support rods, second ends of the two horizontal support rods are rotatably connected to each other, and when the two horizontal support rods are respectively detached from the upper ends of the two vertical support rods, the two horizontal support rods move toward each other through rotating downward;
wherein first ends of the two diagonal support rods are respectively rotatable relative to lower ends of the two vertical support rods, second ends of the two diagonal support rods are rotatably connected to a connecting position of the two horizontal support rods, and the two diagonal support rods are allowed to move toward each other by rotating upward relative to the lower ends of the two vertical support rods;
wherein first ends of the two first connecting rods are respectively rotatably connected to the two diagonal support rods, and second ends of the two first connecting rods are rotatably connected to each other;
wherein the side structure further comprises two second connecting rods, first ends of the two second connecting rods are respectively rotatably connected to the two horizontal support rods, second ends of the two second connecting rods are rotatably connected to a connecting position of the two first connecting rods.

2. The side structure according to claim 1, wherein when the side structure is unfolded, the two first connecting rods and the two horizontal support rods are disposed in parallel.

3. The side structure according to claim 1, wherein the two horizontal support rods define two central points, and the two diagonal support rods define two central points;
wherein in a left-right direction of the side structure, a distance between the first ends of the two first connecting rods is less than a distance between the two central points of the two diagonal support rods; and a distance between the first ends of the two second connecting rods is less than a distance between the two central points of the two horizontal support rods.

4. The side structure according to claim 1, wherein the side structure further comprises an intermediate connecting piece connected to the second ends of the two horizontal support rods, the two horizontal support rods are rotatably connected relative to the intermediate connecting piece, and the second ends of the two diagonal support rods are rotatably connected to the intermediate connecting piece.

5. A playpen framework, comprising:
a plurality of side structures;
wherein each of the side structures comprises two vertical support rods, two horizontal support rods, two diagonal support rods, and two first connecting rods;
wherein the two vertical support rods are disposed in a vertical direction and disposed at intervals in a horizontal direction;
wherein the two horizontal support rods are disposed in the horizontal direction, first ends of the two horizontal support rods are respectively detachably connected to upper ends of the two vertical support rods, second ends of the two horizontal support rods are rotatably connected to each other, and when the two horizontal support rods are respectively detached from the upper ends of the two vertical support rods, the two horizontal support rods move toward each other through rotating downward;
wherein first ends of the two diagonal support rods are respectively rotatable relative to lower ends of the two vertical support rods, second ends of the two diagonal support rods are rotatably connected to a connecting position of the two horizontal support rods, and the two diagonal support rods are allowed to move toward each other by rotating upward relative to the lower ends of the two vertical support rods;
wherein first ends of the two first connecting rods are respectively rotatably connected to the two diagonal support rods, and second ends of the two first connecting rods are rotatably connected to each other;
wherein each of the side structures further comprises two second connecting rods, first ends of the two second connecting rods are respectively rotatably connected to the two horizontal support rods, second ends of the two second connecting rods are rotatably connected to a connecting position of the two first connecting rods,
wherein the plurality of side structures are connected end to end, and each two adjacent side structures share one of the vertical support rods.

6. The playpen framework according to claim 5, wherein the playpen framework further comprises upper corner connectors, each of the upper corner connectors comprises a fixing piece and a locking piece detachably connected to the fixing piece, each fixing piece is slidably sleeved on a corresponding vertical support rod, each of the horizontal support rods is detachably connected to an upper end of each of the vertical support rods through a corresponding fixing piece, and each locking piece is configured to fix a corresponding fixing piece and a corresponding vertical support rod when the playpen framework is unfolded.

7. The playpen framework according to claim 6, wherein each fixing piece comprises a main body portion, the main body portion defines a mounting hole and a positioning hole defined on an outer wall thereof, and the positioning hole thereof communicates the main body portion thereof to an outside;

wherein each of the vertical support rods is slidably disposed in a corresponding mounting hole, the upper end of each of the vertical support rods defines an accommodating cavity with an opening extending upward, each of the vertical support rods defines a fixing hole communicated with the accommodating cavity thereof and the outside, each locking piece is placed into a corresponding accommodating cavity from the opening of the corresponding accommodating cavity, each locking piece passes through a corresponding fixing hole and a corresponding positioning hole to relatively fix a corresponding fixing piece and a corresponding vertical support rod.

8. The playpen framework according to claim 7, wherein each locking piece comprises a locking portion and a first limiting portion, the locking portion thereof is configured to insert into the positioning hole to fix the corresponding fixing piece relative to the corresponding vertical support rod, and the first limiting portion thereof is connected to one side of the locking portion thereof and abuts against an inner wall surface of the corresponding vertical support rod.

9. The playpen framework according to claim 8, wherein each locking piece further comprises an elastic portion, a first end of the elastic portion thereof is connected to the first limiting portion thereof, a second end of the elastic portion thereof is fixedly connected to the corresponding vertical support rod, and the elastic portion thereof is configured to drive the first limiting portion thereof to abut against the inner wall surface of the corresponding vertical support rod.

10. The playpen framework according to claim 7, wherein each fixing piece further comprises a positioning portion connected to an outer wall surface of the main body portion thereof, and the positioning portion thereof defines a fixing groove communicated with the positioning hole thereof;

wherein when the playpen framework is unfolded, each locking piece is at least partially inserted into a corresponding fixing groove, the playpen framework further comprises unlocking pieces, each of the unlocking pieces is at least partially mounted in a corresponding fixing groove and is movable in an axial direction relative to a corresponding positioning portion, and each of the unlocking pieces is capable of driving a portion of a corresponding locking piece located in the corresponding fixing groove to return to a corresponding accommodating cavity.

11. The playpen framework according to claim 10, wherein hooks are disposed on an outer surface of each of the unlocking pieces, each positioning portion defines sliding grooves extending in the axial direction, and the hooks of each of the unlocking pieces are slidable in the sliding grooves of a corresponding positioning portion;

each of the sliding grooves comprises a second limiting portion and a third limiting portion spaced apart from the second limiting portion in a sliding direction, each second limiting portion is configured to prevent a corresponding unlocking piece from being separated from a corresponding positioning portion, when each of the hooks abuts against a corresponding third limiting portion, each of the unlocking pieces drives a corresponding locking piece to return to a corresponding accommodating cavity, and each of the unlocking pieces is located in a corresponding positioning hole.

12. The playpen framework according to claim 11, wherein each of the unlocking pieces further comprises a base portion and a driving portion, each base portion comprises an end cover and a cylinder, and the end cover thereof is connected to one end of the cylinder thereof to define an accommodating groove with an opening on one side of each base portion;

wherein each driving portion is connected to a groove bottom wall of a corresponding accommodating groove, each driving portion at least partially extends out of the opening of the corresponding accommodating groove to drive a corresponding locking piece, a gap is formed between an inner wall of each cylinder and a corresponding driving portion, and the hooks of each unlocking piece are disposed on an outer wall of each cylinder.

13. The playpen framework according to claim 7, wherein the playpen framework further comprises plugs, each of the plugs is detachably mounted on the upper end of each of the vertical support rods to block the opening of each accommodating cavity.

14. The playpen framework according to claim 5, wherein each fixing piece comprises a first mounting portion and a second mounting portion connected to the first mounting portion, the first mounting portion thereof and the second mounting portion thereof are disposed at an included angle, and a connecting position of the first mounting portion and the second mounting portion of each fixing piece defines the first mounting hole;

a first end of one of the two horizontal support rods of an adjacent side structure is rotatably connected to the first mounting portion of each of the side structures, a first end of one of the two horizontal support rods of another adjacent side structure is rotatably connected to the second mounting portion of each of the side structures.

15. The playpen framework according to claim 14, wherein the plurality of side structures are four side structures, and the four side structures are connected to form a rectangular structure;

wherein four upper corner connectors are provided, and an extending direction of the first mounting portion of each fixing piece is perpendicular to an extending direction of the second mounting portion of each fixing piece.

16. The playpen framework according to claim 5, wherein the playpen framework further comprises lower corner connectors, each of the lower corner connectors comprises a first assembling portion and a second assembling portion connected to the first assembling portion, the first assembling portion thereof and the second assembling portion thereof are disposed at an included angle, and an assembling hole is defined in a connecting position of the first assembling portion thereof and the second assembling portion thereof;

wherein a lower end of each of the vertical support rods is inserted into a corresponding assembling hole, a first end of one of the diagonal support rods of an adjacent side structure is rotatably connected to the first assembling portion of each of the side structures, and a first end of one of the diagonal support rods of another adjacent side structure is rotatably connected to the second assembling portion of each of the side structures.

17. The playpen framework according to claim 16, wherein each of the diagonal support rods comprises a main rod and an assembling piece, a first end of each main rod is connected to each assembling piece, and a second end of each main rod is rotatably connected to the connecting position of the two horizontal support rods of each of the side structures, the first end of each main rod is farther from the two horizontal support rods of each of the side structures than the second end of each main rod, and one end of each assembling piece away from each main rod defines an arc surface.

18. A playpen, comprising:

the playpen framework according to claim 6; and a fabric cover covering side portions and a bottom portion of the playpen framework.

19. A folding method of the playpen according to claim 18, comprising steps:

unlocking each fixing piece and the corresponding vertical support rod by each of the unlocking pieces, making each fixing piece to slide downward along the corresponding vertical support rod; and rotating the horizontal support rods respectively detached from the upper ends of the vertical support rods downward, making the diagonal support rods to rotate upward relative to the lower ends of the vertical support rods, making the first connecting rods to rotate upward relative to the diagonal support rod, and making the second connecting rods to rotate upward relative to the horizontal support rods.

* * * * *